US006752608B1

(12) United States Patent
Yap

(10) Patent No.: US 6,752,608 B1
(45) Date of Patent: Jun. 22, 2004

(54) COMPRESSOR CRANKSHAFT WITH BEARING SLEEVE AND ASSEMBLY METHOD

(75) Inventor: Zer Kai Yap, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/447,712

(22) Filed: May 29, 2003

(51) Int. Cl.[7] ..... F03C 2/00

(52) U.S. Cl. ..... 418/63; 418/60; 418/64; 418/65; 418/66; 418/67; 184/6.18; 384/584; 417/902; 29/888.025

(58) Field of Search ..... 418/60, 63, 9, 418/1, 64, 65, 66, 67; 184/6.16, 6.18; 384/584; 417/366, 902, 295; 29/888.025

(56) References Cited

U.S. PATENT DOCUMENTS

| | | | | | |
|---|---|---|---|---|---|
| 2,040,641 | A | * | 5/1936 | Bingham | 418/97 |
| 3,432,704 | A | * | 3/1969 | Nelson | 310/87 |
| 3,762,837 | A | * | 10/1973 | Ellis et al. | 417/902 |
| 4,425,520 | A | | 1/1984 | Hiraga | |
| 4,472,122 | A | | 9/1984 | Yoshida et al. | |
| 4,494,286 | A | | 1/1985 | Kaufman | |
| 4,826,408 | A | * | 5/1989 | Inoue et al. | 418/63 |
| 4,869,604 | A | | 9/1989 | Hill et al. | |
| 5,044,908 | A | | 9/1991 | Kawade | |
| 5,099,559 | A | | 3/1992 | McGrath | |
| 5,230,275 | A | | 7/1993 | Hodge et al. | |
| 5,232,351 | A | * | 8/1993 | Robertson et al. | 184/6.18 |
| 5,240,387 | A | | 8/1993 | Nakajima et al. | |
| 5,328,275 | A | | 7/1994 | Winn et al. | |
| 5,344,240 | A | | 9/1994 | Tatro et al. | |
| 5,380,112 | A | | 1/1995 | Schicktanz et al. | |
| 5,531,578 | A | | 7/1996 | Takemoto et al. | |
| 5,954,489 | A | | 9/1999 | Kinoshita | |
| 6,172,436 | B1 | | 1/2001 | Subler et al. | |
| 6,280,097 | B1 | | 8/2001 | Mues et al. | |
| 6,631,617 | B1 | * | 10/2003 | Dreiman et al. | 417/295 |

FOREIGN PATENT DOCUMENTS

| | | | | | |
|---|---|---|---|---|---|
| DE | 643779 | | * | 3/1937 | 418/67 |
| DE | 2556654 | A | * | 7/1976 | B62D/5/06 |
| GB | 1471720 | A | * | 4/1977 | B62D/5/06 |

* cited by examiner

*Primary Examiner*—Thomas Denion
*Assistant Examiner*—Theresa Trieu
(74) *Attorney, Agent, or Firm*—Baker & Daniels

(57) ABSTRACT

A compressor assembly having a drive shaft supported by a main bearing and an outboard bearing located on opposite axial ends of a cylinder block. The main bearing has a bearing support formed therein in which first and second apertures are defined. The diameter of the first aperture is less than the diameter of the second aperture. The shaft extends through the first and second apertures with the diameter of the drive shaft having an outer diameter which is no greater than the diameter of the first aperture. A sleeve is mounted on the drive shaft and is at least partially disposed within the second aperture. A bearing is located in the second aperture and engages the sleeve and the main bearing to rotationally support the drive shaft. The sleeve can have a thickness which allows the bearing to be of a standard size rather than a custom size.

18 Claims, 2 Drawing Sheets

COMPRESSOR CRANKSHAFT WITH BEARING SLEEVE AND ASSEMBLY METHOD

BACKGROUND OF THE INVENTION

The present invention relates to compressors, and more specifically to bearings for rotatably supporting the crankshaft of the compressor.

In a typical hermetic compressor assembly, a motor and a compression mechanism are mounted in the compressor housing and drivingly linked by a crankshaft or drive shaft. Often, the compression mechanism is supported by a frame or crankcase through which the drive shaft extends to drivingly engage the compression mechanism. An eccentric portion is typically provided on the drive shaft and engages the compression mechanism. In a rotary compressor, a roller is conventionally mounted on the eccentric portion with a journal bearing located between the roller and the eccentric portion of the drive shaft. The drive shaft is also typically rotatably supported in the crankcase or bearing support by a main bearing at a location between the roller and motor driving the crankshaft and at an end of the crankshaft opposite the motor by an outboard bearing located on the opposite side of the compression mechanism from the main bearing.

Oftentimes an opening or aperture in the crankcase that faces the compressor mechanism has dimensions which are governed by the functionality of the compressor mechanism. For example, in a rotary compressor, the opening in the crankcase facing the roller of the compressor mechanism must be sufficiently small so that the opening does not intrude into the compression chamber and allow the release of vapors from the compression chamber. This, in turn, can influences the dimensions of the crankshaft by defining a maximum diameter of at least that length of the crankshaft which is inserted through the crankcase opening. The bearings mounted on this length of the crankshaft is also thereby affected.

SUMMARY OF THE INVENTION

The present invention relates to compressor assemblies and provides a sleeve on the crankshaft of the compressor assembly and a bearing mounted on the sleeve to rotatably support the crankshaft. As described below, this facilitates the use of a bearing on a length of the crankshaft that has been inserted through an opening in the crankcase wherein the bearing has an inside diameter which is at least as great as the opening in the crankcase by mounting the bearing on the sleeve.

The present invention comprises, in one form thereof, a compressor assembly that includes a compressor mechanism, a motor having a stator and a rotor and a crankcase (56, 72) disposed between the compressor mechanism and the rotor wherein the crankcase defines a first aperture (92) having a first minimum diameter $D_1$. A bearing support (57, 73) defining a second aperture (95) having a second minimum diameter $D_2$ is also provided and the second aperture is disposed between the crankcase aperture and the rotor. A crankshaft (44, 46), extending from a first end (61, 75) to an opposite second end (60, 76), is operably coupled to the rotor proximate the first end (61, 75) and operably coupled to the compressor mechanism proximate the second end (60, 76). The crankshaft (44, 46) extends through the first and second apertures and a length (80) of the crankshaft extending within the first aperture and to the first end (61, 75) has an outer diameter $D_3$ no greater than the first minimum diameter. At least a portion (82) of the crankshaft between the first aperture and the second end defines an outer diameter $D_4$ greater than the first minimum diameter. A sleeve (98) is mounted on the crankshaft and is at least partially disposed within the second aperture. The sleeve defines an outer diameter $D_5$ at least as great as the first minimum diameter and a bearing (86) is disposed within the second aperture and engaged with the sleeve whereby the bearing provides rotational support for the crankshaft.

A second bearing support and a second bearing mounted within the second bearing support may also be provided in some embodiments wherein the second bearing rotatably supports the crankshaft at a position on the crankshaft between the first aperture and the second end where the crankshaft defines an outer diameter greater than the first minimum diameter.

The crankshaft may include an eccentric portion between the first aperture and the second end defining an outer diameter greater than said first minimum diameter wherein the eccentric portion is operably coupled with the compressor mechanism. The crankcase may also include a planar surface surrounding the first aperture wherein the eccentric portion has a roller mounted thereon wherein the roller extends radially outwardly of the first aperture through a complete rotation of the crankshaft. The compressor mechanism may also be a rotary compressor and include a roller mounted on the eccentric portion with a third bearing operably disposed between the eccentric portion and the roller.

The sleeve of particular embodiments may define an outer diameter that is greater than said first minimum diameter. The sleeve may also have a substantially cylindrical radially inward surface engaging the crankshaft and a substantially cylindrical radially outward surface engaging the bearing. The bearing may be a roller bearing having an inner raceway engaged with the sleeve, an outer raceway engaged with the bearing support and a set of substantially cylindrical rollers disposed between said inner and outer raceways. The bearing support may be integrally formed with the crankcase.

The invention comprises, in another form thereof, a compressor assembly including a compressor mechanism, a motor having a stator and a rotor and a bearing support member (57, 73) disposed between the compressor mechanism and the rotor. The bearing support member defines a stepped opening having a first portion (92) defining a first minimum diameter $D_1$ and a second portion (95) defining a second minimum diameter $D_2$. The second portion is disposed between the rotor and the first portion and the second minimum diameter is greater than the first minimum diameter. A crankshaft (44, 46), extending from a first end (61, 75) to an opposite second end (60, 76), is operably coupled to the rotor proximate the first end and operably coupled to the compressor mechanism proximate the second end. The drive shaft extends through the first and second portions of the opening wherein a length (80) of the crankshaft extending within the opening and to the first end has an outer diameter $D_3$ no greater than the first minimum diameter and wherein at least a portion (82) of the crankshaft between the opening and the second end defines an outer diameter $D_4$ greater than the first minimum diameter. A sleeve (98) is mounted on the crankshaft and at least partially disposed within the second portion of the opening. The sleeve defines an outer diameter $D_5$ at least as great as the first minimum diameter and a bearing (86) is disposed within the second portion of the opening and engaged with the sleeve whereby the bearing provides rotational support for the crankshaft.

The crankshaft may also include an eccentric portion between the first portion of the stepped opening and the second end that defines an outer diameter greater than the first minimum diameter wherein the eccentric portion is operably coupled with the compressor mechanism.

The invention comprises, in yet another form thereof, a method of manufacturing a compressor assembly that includes providing a crankcase (56, 72) defining a first aperture (92) having a first minimum diameter $D_1$ and a crankshaft (44, 46) having a first end (61, 75) and an opposite second end (60, 76). The method also includes inserting the first end of the crankshaft through the first aperture wherein the crankshaft extends through the first aperture and at least a portion (82) of the crankshaft between the first aperture and the second end defines an outer diameter $D_4$ greater than the first minimum diameter. A sleeve (98) is mounted on the crankshaft after inserting the first end of the crankshaft through the first aperture at a location between (80) the first end and the first aperture wherein the sleeve includes an outer diameter $D_5$ at least as great as the first minimum diameter. The method also includes mounting a bearing (86) on the sleeve for rotatably supporting the crankshaft and operably coupling a compressor mechanism to the crankshaft.

The portion of the crankshaft between the first aperture and the second end defining an outer diameter greater than the first minimum diameter in some embodiments may be an eccentric portion and the compressor mechanism may be operably coupled to the eccentric portion. The method may also include operably coupling a motor to the crankshaft between the first end and the first aperture. The bearing may include an inner raceway, an outer raceway and a set of substantially cylindrical rollers disposed between the inner and outer raceways and the mounting of the bearing on the sleeve may comprise engaging a radially inward facing surface on said inner raceway with the sleeve.

The method may also include providing a bearing support defining a second aperture having a second minimum diameter greater than the first minimum diameter and disposing the bearing within the second aperture. The crankcase may, in some embodiments, include an integral bearing support portion defining a second aperture having a second minimum diameter greater than the first minimum diameter wherein the method further includes disposing the bearing within the second aperture.

One advantage of the present invention is that the use of a sleeve with the bearing positioned between the crankcase aperture and the motor allows the bearing to have a larger inside diameter than the minimum diameter of the crankcase aperture thereby providing greater support for the crankshaft.

A further advantage of the present invention is that sleeve can have a thickness which allows the bearing positioned thereon to be a standard sized bearing rather than a custom sized bearing whereby the compressor assembly can be manufactured in a cost efficient manner.

BRIEF DESCRIPTION OF THE DRAWINGS

The above-mentioned and other features and objects of this invention, and the manner of attaining them, will become more apparent when the invention itself will be better understood by reference to the following description of an embodiment of the invention taken in conjunction with the accompanying drawings, wherein.

Figure 1:
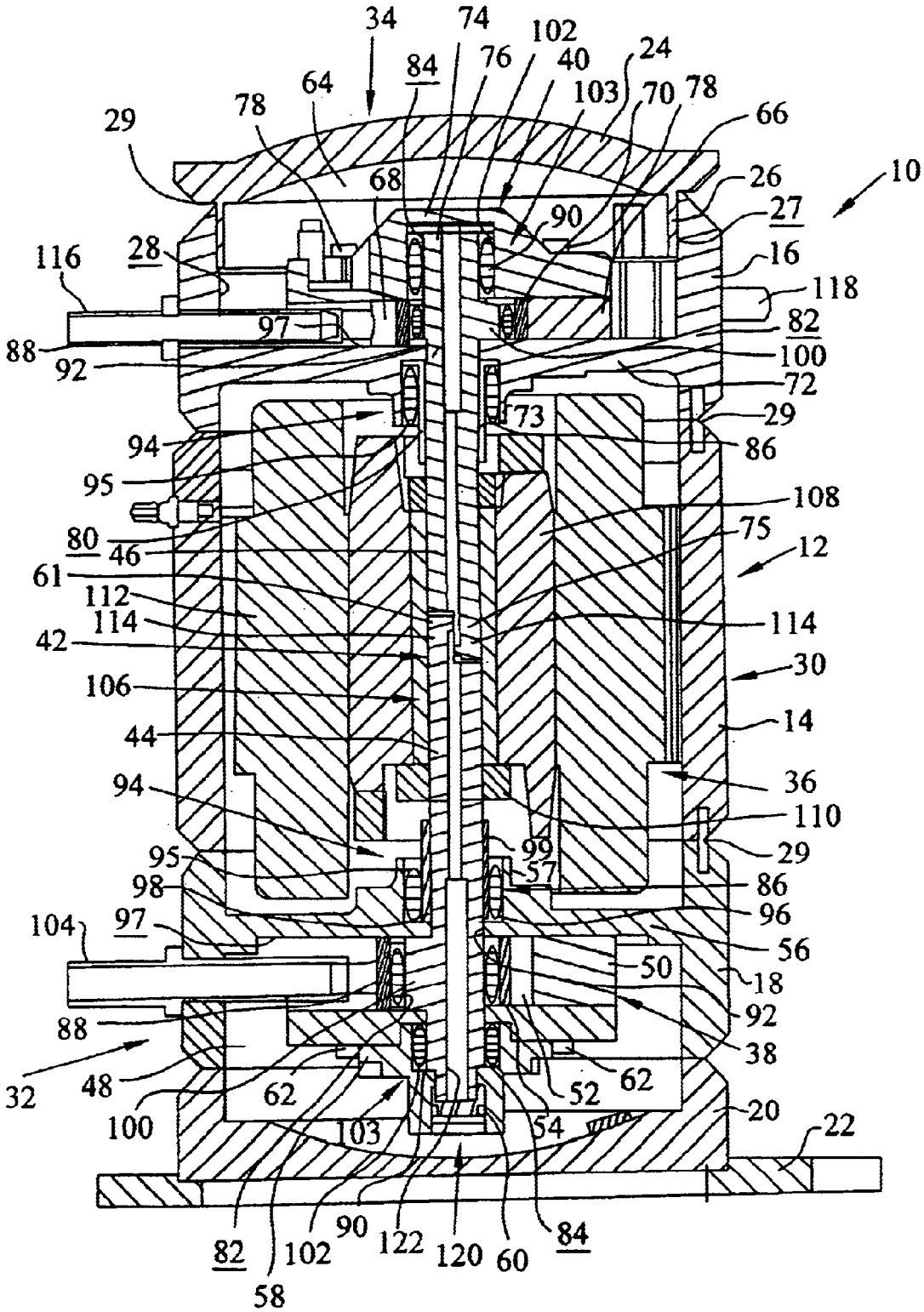
FIG. 1 is a sectional view of a compressor assembly in accordance with the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Referring to FIG. 1, hermetic compressor 10 is illustrated a two-stage rotary type compressor, which uses carbon dioxide as the working fluid. However, compressor 10 may be any suitable type of compressor including rotary, scroll and reciprocating piston compressors. For example, a compressor that may be adapted for use with the present invention is described in U.S. patent application Ser. No. 10/183,727 filed Jun. 27, 2002, the disclosure of which is hereby incorporated herein by reference.

Illustrated compressor 10 includes housing 12 having main body portion 14 to which upper and lower housing portions 16 and 18 are secured. Mounted to the opposite edge of lower housing portion 18 is base portion 20 having support 22 for orienting compressor 10 in a substantially vertical position. The present invention may also be used with non-vertically oriented compressors such as horizontally oriented compressors. End cap 24 engages the upper edge of upper housing portion 16 with annular flange 26 of end cap 24 being interference fitted into the upper housing portion. Outer surface 27 of annular flange 26 is in engagement with inner surface 28 of upper housing portion 16.

Housing 12 is constructed from any suitable material able to withstand the high pressures created when using carbon dioxide as the working fluid and is made by any suitable method. The housing portions are secured to one another at joints 29 by welding, brazing, or the like.

The construction of compressor 10 is modular including motor assembly module 30, lower compression mechanism module 32, and upper compression mechanism module 34. Motor assembly module 30 houses motor 36 which is drivingly linked to lower and upper compression mechanisms 38 and 40 of lower and upper compression mechanism modules 32 and 34, respectively, by drive shaft assembly 42.

Figure 2:
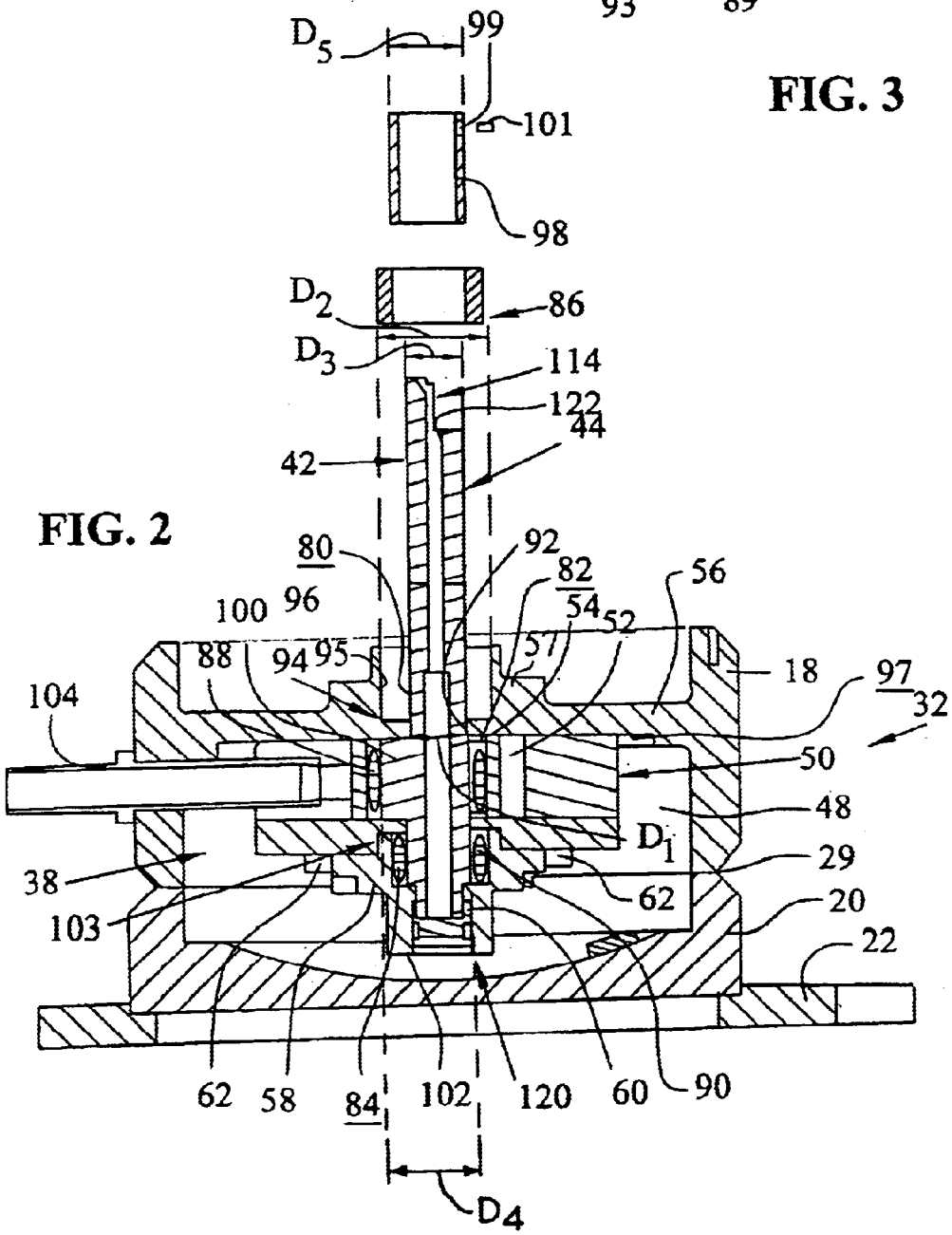
FIG. 2 is a sectional view of the lower compression mechanism module of the compressor assembly of FIG. 1 having the bearing and sleeve of the present invention exploded therefrom.

Referring to FIG. 2, lower compression mechanism module 32 houses lower compression mechanism 38 which is located substantially in cavity 48 defined by lower housing portion 18 and base portion 20. Drive shaft assembly 42 is formed from two separate drive shafts 44 and 46 with lower shaft 44 operatively engaged with lower compression mechanism 38 and extending through housing portion 18 to engage motor 36. Compression mechanism 38 includes cylinder block 50 with compression chamber 52 defined therein by roller 54 and at least one vane (not shown). Crankcase 56 includes an integral main bearing support 57 and is integrally formed in housing portion 18 to rotatably support shaft portion 44. In alternative embodiments, the crankcase and main bearing support may be formed separately from the housing or the crankcase, the main bearing support and the housing may each be separate parts. The crankcase partially encloses a portion of the drive shaft. Compression mechanism 38 is positioned adjacent crankcase 56 having sealing contact therewith so as to close one end of compression chamber 52. Secured to the opposite side of compression mechanism 38 is outboard bearing support 58 which sealingly closes the compression chamber 52 and rotatably supports end 60 of shaft 44. Fasteners 62 extend through outboard bearing support 58 and cylinder block 50 to engage crankcase 56 and secure compression mechanism 38 in lower compression mechanism module 32.

The construction of upper compression mechanism module 34 is similar to that of lower compression mechanism module 32. Referring to FIG. 1, upper compression mechanism 40 of upper compression mechanism module 34 is substantially located in cavity 64 defined by upper housing portion 16 and end cap 24. Upper drive shaft 46 operatively engages upper compression mechanism 40 and extends through housing portion 16 to operatively engage lower drive shaft 44 as will be described further hereinbelow. Upper compression mechanism 40 includes cylinder block 66 having compression chamber 68 defined therein by roller 70, at least one vane (not shown), crankcase 72, and outboard bearing support 74. Crankcase 72 includes an integrally formed main bearing support 73 and is also integrally formed with housing portion 16 to rotatably support shaft 46. One side of compression mechanism 40 is positioned adjacent crankcase 72 such that crankcase 72 forms one end of sealed compression chamber 68. Outboard bearing support 74 is located adjacent the opposite side of upper compression mechanism 40 to sealingly close compression chamber 68 and rotatably support end 76 of drive shaft 46. Fasteners 78 extending through outboard bearing 74 and cylinder block 66 to engage crankcase 72 and secure compression mechanism 40 in upper compression mechanism module 34.

Figure 3:
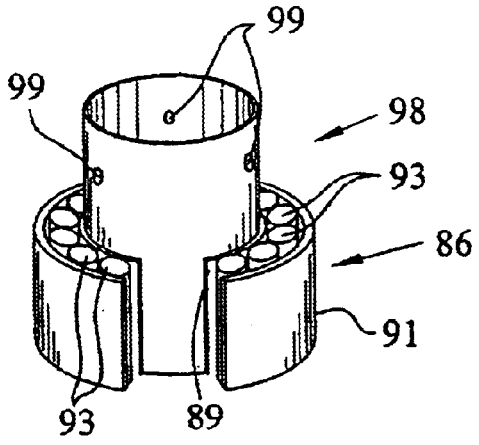
FIG. 3 is a perspective view of the bearing and the sleeve of the present invention, a portion of the bearing being cut away for illustration purposes.

Referring to FIGS. 1 and 2, drive shafts 44 and 46 of upper and lower compression mechanism modules 32 and 34 are each provided with a plurality of bearing surfaces 80, 82, and 84. Bearing surfaces 80, 82, and 84 are engaged by conventional rollers bearings 86, 88, and 90 to rotatably support the drive shaft in main bearing supports 57 and 73, compression mechanisms 38 and 40, and outboard bearing supports 58 and 74, respectively. Bearing 86 is illustrated in FIG. 3 in a partially broken away view. Bearing 86 fully encircles sleeve 98. Bearing 86 includes inner raceway 91, outer raceway 93, and a plurality of rollers 95 located therebetween. Bearings 88 and 90 have a similar construction with an inner raceway 91, outer raceway 93 and plurality of rollers 95 located therebetween. In the illustrated emodiment, bearings 86, 88, 90 are Torrington needle roller bearings, serial numbers HJ-162416, BH-208, and HJ-142212, respectively, available from The Timken Company having a place of business in Canton, Ohio. Alternative embodiments, however, may employ different types of bearings for supporting the drive shaft such as ball bearing assemblies.

Shafts 44 and 46 pass through a stepped opening formed in crankcases 56 and 72 which includes a first aperture 92 and a second aperture 95. such that first bearing surfaces 80 on shafts 44, 46 are aligned with main bearing supports. Aperture 92 has a minimum diameter, which is substantially equal to the diameter of shafts 44 and 46 at bearing surface 80 and allows shaft ends 61, 75 of shafts 44, 46 to be inserted therethrough as described in greater detail below. Bearing support collar 94 is provided on crankcases 56 and 72 and defines aperture 95 and cavity 96 which together define the integral main bearing support portions 57, 73 of crankcases 56, 72. Aperture 95 has a minimum diameter which is greater than the minimum diameter of aperture 92. This allows cavity 96 to receive a roller bearing 86 and sleeve 98 for rotatably supporting shaft portions 44 and 46 and aperture 92 to be sufficiently small so that it does not project radially outwardly beyond rollers 54, 70 mounted on the eccentric portions 100 of shafts 44, 46 and thereby prevent aperture 92 from being placed in communication with the working compression chambers of compression mechanisms 38, 40. Aperture 92 is also sufficiently small to prevent the passage of eccentric portions 100 therethrough.

Roller bearing 86 is a standard sized bearing having an outer diameter substantially equal to the diameter of the radially inward facing surface of cavity 96. Sleeve 98 is shown in FIG. 3 and is substantially cylindrical having an inner diameter, which is substantially equal to the outer diameter of shafts 44 and 46 and an outer diameter substantially equal to the diameter of the radially inward facing surface of the inner race 89 of the bearing 86 mounted thereon. In other words, sleeve 98 is provided with a thickness to cooperate with both the shaft diameter and the inside diameter of the bearing. Sleeve 98 may be constructed from any suitable material including cold rolled steel, for example. The use of sleeve 98 facilitates the use of a larger roller bearing and a standard sized roller bearing within cavity by allowing roller bearing 86 to have an inner raceway with an inner diameter that is larger than the outer diameter of shafts 44, 46 positioned within cavity 96 and still allows for the passage of this portion of shafts 44, 46 through relatively smaller aperture 92.

Second bearing surfaces 82 are positioned on drive shafts 44 and 46 in alignment with compression mechanisms 38 and 40. Rollers 54 and 70 are disposed about bearing surface 82 which has eccentric portion 100 integrally formed therewith to drive the compression operation. Roller bearing 88 is located between bearing surface 82 and the inner cylindrical surface of rollers 54 and 70, having an interference fit therewith to rotatably support rollers 54, 70 on shafts 44 and 46.

Located near ends 60 and 76 of drive shafts 44 and 46, are roller bearings 90 mounted on third bearing surfaces 84 of shafts 44, 46 and operatively engaged with the inner cylindrical surface of aperture 102 defined in bearing support 103 formed in outboard bearing support members 58 and 74. Roller bearings 90 are interference fitted between the inner cylindrical surface of apertures 102 and bearing surfaces 84 to rotatably support shafts 44 and 46.

In the illustrated embodiment, outer diameters of drive shafts 44 and 46 at bearing surfaces 80, 82, and 84 are such that the shaft diameter at bearing surface 80 is less than the shaft diameter at bearing surface 84. This facilitates the proper assembly of the shafts and crankcases, preventing shafts 44 and 46 from being improperly positioned when being assembled with the main bearings. Bearing surface 82 is substantially larger in diameter than bearing surfaces 80 and 84 having eccentric portion 100 integrally formed therewith.

In the illustrated embodiment, the shaft diameter at bearing surface 80 is 0.8107 inches. The shaft diameters at bearing surfaces 82 and 84 are 1.25 and 0.875 inches, respectively. Bearings 86, 88, and 90 are standard sized bearings having an outer diameter of 1, 1.25, and 0.875 inches, respectively. The inner and outer diameter measurements of sleeve 98 are 0.8107 and 1 inches, respectively, so that the radially inner and radially outer surfaces of sleeve 98 are respectively in contact with the radially outer surface of shafts 44 and 46, and the radially inner surface of the inner race of the bearings mounted on the sleeves.

The assembly of compressor 10 will now be described. Lower compression mechanism module 32 is assembled first with compression mechanism 38 being assembled to shaft 44 with bearing 88 and roller 54 being mounted on eccentric portion 100 of shaft 44. Shaft end 61 of shaft 44 is then passed through aperture 92 until compression mechanism 38 engages the surface of crankcase 56. Outboard bearing support 58 is positioned adjacent the opposite side of compression mechanism 38. Roller bearing 90 is mounted on shaft 44 and end 60 of shaft 44 is positioned in outboard bearing support 58. Fasteners 62 secure outboard bearing support 58 and compression mechanism 38 to crankcase 56. Base portion 20 is secured to housing portion 18 to define cavity 48. First stage suction tube 104 is mounted in housing portion 18 to engage compression mechanism 38. Sleeve 98 is slip fitted onto shaft portion 44 and is positioned within main bearing cavity 96. A plurality of apertures 99 are circumferentially spaced about sleeve 98 at a position axially spaced from the installed position of roller bearing 86. Fasteners 101 are received in apertures 99 and contact shaft portion 44 to secure sleeve 98 thereto. Fasteners 101 may be of any suitable type including a setscrew, pin, or the like. Roller bearing 86 is then press fit into main bearing cavity 96 with an interference fit between outer raceway 93 and main bearing support 57. In the illustrated embodiment, the inner raceway 91 and sleeve 98 are frictionally engaged but the contact between inner raceway 91 and sleeve 98 is not an interference fit. In alternative embodiments, cavity 96 in main bearing supports 57, 75 may include an annular groove for receiving a locking ring to secure roller bearing 86 within cavity 96.

Once assembly of lower compression mechanism module 32 is complete, motor module 30 is assembled thereto. A substantially cylindrical sleeve 106 is lowered onto end 61 of shaft 44 with shaft 44 extending approximately half way into sleeve 106. Rotor 108 is then mounted to sleeve 106 being seated on flange portion 110 of sleeve 106. Sleeve 106 and rotor 108 are secured to shaft 44 by heat shrinking such that rotation of rotor 108 causes rotation of shaft portion 44. Main body housing portion 14 is positioned about stator 112 and is heat shrunk onto the stator. The housing and stator assembly is then lowered onto the rotor and shaft assembly until main body housing portion 14 contacts lower housing portion 18 and stator 112 and rotor 108 are appropriately aligned. Housing portions 14 and 18 are then secured to one another.

Compression mechanism 40 of upper compression mechanism module 34 is assembled in a similar manner as compression mechanism 38 with compression mechanism 40 first being mounted onto shaft 46. End 75 of shaft 46 is passed through aperture 92 until compression mechanism 40 engages the surface of crankcase 72. Outboard bearing support 74 is positioned adjacent the opposite side of compression mechanism 40 with roller bearing 90 being positioned about shaft 46 and shaft end 76 rotatably supported in outboard bearing support 74. Fasteners 78 secure outboard bearing support 74 and compression mechanism 40 to crankcase 72.

Sleeve 98 and roller bearing 86 are mounted to shaft portion 44, after shaft end 75 has been inserted through aperture 92 with roller bearing 86 being mounted in main bearing cavity 96 with an interference fit. The diameter of that portion of shaft 46 inserted into sleeve 106 is slightly smaller than that portion of shaft 44 mounted in sleeve 106. This allows shaft 46 to be slidably received in sleeve 106 after sleeve 106 and rotor 108 are heat shrunk to shaft 44. Drive shafts 44 and 46 are each provided with linking portions 114 which engage one another to drivingly link shafts 44, 46. Upper housing portion 16 is seated against main body housing portion 14 and is secured thereto. End cap 24 is secured to housing portion 16. Second stage inlet tube 116 and discharge tube 118 are mounted in housing portion 16, engaging compression mechanism 40.

During operation of two-stage compressor 10, motor 36 is energized causing rotation of rotor 108 and thus shaft 44. Through the driving link between shafts 44 and 46, shaft 46 rotates together with shaft 44 and the rotation of shafts 44, 46 drives compression mechanisms 38 and 40 in a manner well known in the art. Oil pump 120 is located in outboard bearing support 58 and is submersed in oil located in the bottom of lower compression mechanism module 32. As drive shaft assembly 42 rotates, oil pump 120 draws oil from module 32, through bore 122 which extends through both shafts 44, 46 and to bearing surfaces 80, 82, and 84.

Suction pressure gas is drawn into lower compression mechanism 38 from a refrigeration system (not shown) through a suction inlet tube 104. The suction pressure gas is compressed to an intermediate pressure and the gas is discharged through first stage discharge tube (not shown) to an intercooler (not shown). The cooled, intermediate pressure gas enters upper compression mechanism 40 through second stage inlet tube 116 and is compressed to a higher, discharge pressure. The discharge pressure gas is then supplied to the refrigeration system through discharge outlet 118.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A compressor assembly comprising:

a compressor mechanism;

a motor having a stator and a rotor;

a crankcase disposed between said compressor mechanism and said rotor, said crankcase defining a first aperture having a first minimum diameter;

a bearing support defining a second aperture having a second minimum diameter, said second aperture disposed between said crankcase aperture and said rotor;

a crankshaft extending from a first end to an opposite second end; said crankshaft operably coupled to said rotor proximate said first end and operably coupled to said compressor mechanism proximate said second end, said crankshaft extending through said first and second apertures and wherein a length of said crankshaft extending within said first aperture and to said first end has an outer diameter no greater than said first minimum diameter and wherein at least a portion of said crankshaft between said first aperture and said second end defines an outer diameter greater than said first minimum diameter;

a sleeve mounted on said crankshaft and at least partially disposed within said second aperture, said sleeve defining an outer diameter at least as great as said first minimum diameter; and a bearing disposed within said second aperture and engaged with said sleeve whereby said bearing provides rotational support for said crankshaft.

2. The compressor mechanism of claim 1 further comprising a second bearing support and a second bearing mounted within said second bearing support, said second bearing rotatably supporting said crankshaft at a position on said crankshaft between said first aperture and said second end where said crankshaft defines an outer diameter greater than said first minimum diameter.

3. The compressor assembly of claim 1 wherein said crankshaft includes an eccentric portion between said first aperture and said second end defining an outer diameter greater than said first minimum diameter, said eccentric portion being operably coupled with said compressor mechanism.

4. The compressor assembly of claim 3 wherein said crankcase has a planar surface surrounding said first aperture and said eccentric portion has a roller mounted thereon wherein said roller extends radially outwardly of said first aperture through a complete rotation of said crankshaft.

5. The compressor assembly of claim 3 wherein said compressor mechanism is a rotary compressor and said compressor assembly further comprises a roller mounted on said eccentric portion and a third bearing operably disposed between said eccentric portion and said roller.

6. The compressor assembly of claim 1 wherein said sleeve defines an outer diameter greater than said first minimum diameter.

7. The compressor assembly of claim 1 wherein said bearing support is integrally formed with said crankcase.

8. The compressor assembly of claim 1 wherein said bearing is a roller bearing comprising an inner raceway engaged with said sleeve, an outer raceway engaged with said bearing support and a set of substantially cylindrical rollers disposed between said inner and outer raceways.

9. The compressor assembly of claim 1 wherein said sleeve has a substantially cylindrical radially inward surface engaging said crankshaft and a substantially cylindrical radially outward surface engaging said bearing.

10. A compressor assembly comprising:

a compressor mechanism;

a motor having a stator and a rotor;

a bearing support member disposed between the compressor mechanism and the rotor, said bearing support member defining a stepped opening having a first portion defining a first minimum diameter and a second portion defining a second minimum diameter, said second portion disposed between said rotor and said first portion, said second minimum diameter being greater than said first minimum diameter;

a crankshaft extending from a first end to an opposite second end, said crankshaft operably coupled to said rotor proximate said first end and operably coupled to said compressor mechanism proximate said second end, said drive shaft extending through said first and second portions of said opening wherein a length of said crankshaft extending within said opening and to said first end has an outer diameter no greater than said first minimum diameter and wherein at least a portion of said crankshaft between said opening and said second end defines an outer diameter greater than said first minimum diameter;

a sleeve mounted on said crankshaft and at least partially disposed within said second portion of said opening, said sleeve defining an outer diameter at least as great as said first minimum diameter; and a bearing disposed within said second portion of said opening and engaged with said sleeve whereby said bearing provides rotational support for said crankshaft.

11. The compressor assembly of claim 10 wherein said crankshaft includes an eccentric portion between said first portion and said second end defining an outer diameter greater than said first minimum diameter, said eccentric portion being operably coupled with said compressor mechanism.

12. A method of manufacturing a compressor assembly, said method comprising:

providing a crankcase defining a first aperture having a first minimum diameter and a crankshaft having a first end and an opposite second end;

inserting the first end of the crankshaft through the first aperture wherein the crankshaft extends through the first aperture and at least a portion of the crankshaft between the first aperture and the second end defines an outer diameter greater than the first minimum diameter;

mounting a sleeve on the crankshaft after inserting the first end of the crankshaft through the first aperture at a location between the first end and the first aperture and wherein the sleeve includes an outer diameter at least as great as the first minimum diameter;

mounting a bearing on the sleeve for rotatably supporting the crankshaft; and operably coupling a compressor mechanism to the crankshaft.

13. The method of claim 12 wherein the portion of the crankshaft between the first aperture and the second end defining an outer diameter greater than the first minimum diameter is an eccentric portion and the compressor mechanism is operably coupled to the eccentric portion.

14. The method of claim 12 wherein said method further includes operably coupling a motor to the crankshaft between the first end and the first aperture.

15. The method of claim 12 wherein said method further includes providing a bearing support defining a second aperture having a second minimum diameter greater than the first minimum diameter and disposing the bearing within the second aperture.

16. The method of claim 12 wherein said crankcase includes an integral bearing support portion defining a second aperture having a second minimum diameter greater than the first minimum diameter and said method further includes disposing the bearing within the second aperture.

17. The method of claim 12 wherein the bearing includes an inner raceway, an outer raceway and a set of substantially cylindrical rollers disposed between the inner and outer raceways and wherein mounting the bearing on the sleeve comprises engaging a radially inward facing surface on said inner raceway with the sleeve.

18. The method of claim 12 wherein the sleeve includes a plurality of apertures located therein, the apertures circumferentially spaced, and a fastener located in each the apertures securing said sleeve to the shaft.

* * * * *